US005839651A

United States Patent [19]

Teags et al.

[11] Patent Number: 5,839,651

[45] Date of Patent: Nov. 24, 1998

[54] ASPARAGUS BOX

[75] Inventors: William G. Teags, Cave Creek; Mark G. Wordekemper, Phoenix, both of Ariz.

[73] Assignee: Advanced Package Engineering, Inc., Phoenix, Ariz.

[21] Appl. No.: 856,884

[22] Filed: May 15, 1997

[51] Int. Cl.[6] ..... B65D 43/08

[52] U.S. Cl. ..... 229/125.32; 229/915; 229/119; 229/120; 229/198.2; 229/23 R; 229/939; 206/511

[58] Field of Search ..... 229/147, 430, 229/931, 937, 125.32, 119, 120, 198.2, 915, 939, 23 R; 206/511, 512, 403; 24/662; 403/329, 326

[56] References Cited

U.S. PATENT DOCUMENTS

| | | | |
|---|---|---|---|
| D. 229,485 | 12/1973 | Petersen . | |
| D. 356,253 | 3/1995 | Bacchetti et al. . | |
| 2,484,975 | 10/1949 | Saun | 229/23 R |
| 2,657,849 | 11/1953 | Paul et al. | 229/23 R |
| 2,661,139 | 12/1953 | Brooks | 229/23 R |
| 3,069,060 | 12/1962 | Chamberlin, Jr. | 229/23 R X |
| 3,485,433 | 12/1969 | Rapp | 229/23 R |
| 3,486,680 | 12/1969 | Negus, Jr. | 229/915 X |
| 3,744,707 | 7/1973 | Ross | 206/511 |
| 3,863,829 | 2/1975 | Merrill . | |
| 4,053,100 | 10/1977 | Baptist | 206/512 |
| 4,105,152 | 8/1978 | Elward . | |
| 4,127,228 | 11/1978 | Hall . | |
| 4,373,659 | 2/1983 | Cornell et al. | 206/511 |
| 4,482,074 | 11/1984 | Lalley | 229/23 R |
| 4,775,097 | 10/1988 | Katzman | 229/125.32 X |
| 5,042,713 | 8/1991 | Stafford | 229/23 R |
| 5,046,659 | 9/1991 | Warburton | 24/662 |
| 5,163,609 | 11/1992 | Muise, Jr. . | |
| 5,462,220 | 10/1995 | Bacchetti et al. . | |

FOREIGN PATENT DOCUMENTS

| | | |
|---|---|---|
| 1706933 | 1/1992 | U.S.S.R. . |

*Primary Examiner*—Allan N. Shoap
*Assistant Examiner*—Tri M. Mai
*Attorney, Agent, or Firm*—Cahill, Sutton & Thomas P.L.C.

[57] ABSTRACT

A plurality of tabs extend from three edges of each head of a pair of heads for penetrably engaging respective ones of a plurality of slots disposed along opposed edges of a wrap to form an asparagus box. The pair of heads and wrap are formed from corrugated plastic sheet material and the wall segments present in opposed overhangs of each tab engage opposed triangular elements disposed at opposed ends of each slot to restrain the tab but accommodate disassembly and reassembly. A tray receives and supports the open end of the asparagus box to form a container and includes a plurality of slots for receiving tabs protruding from the wrap of an adjacent stacked container to stabilize stacking of the containers.

11 Claims, 4 Drawing Sheets

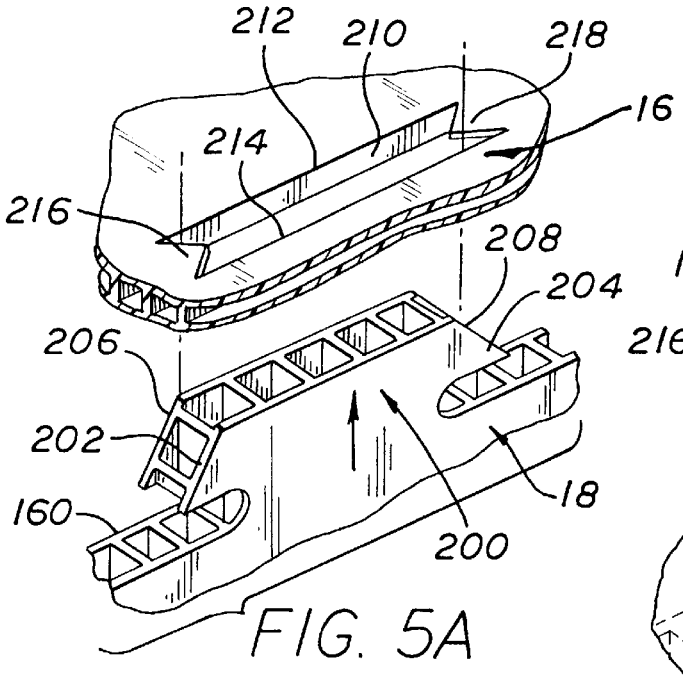
FIG. 5A
FIG. 5B
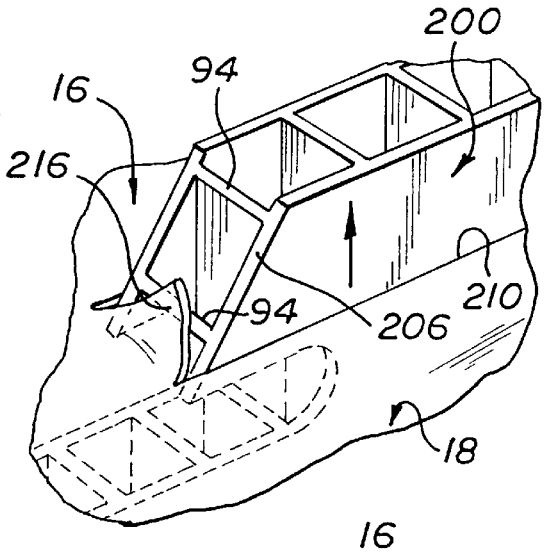
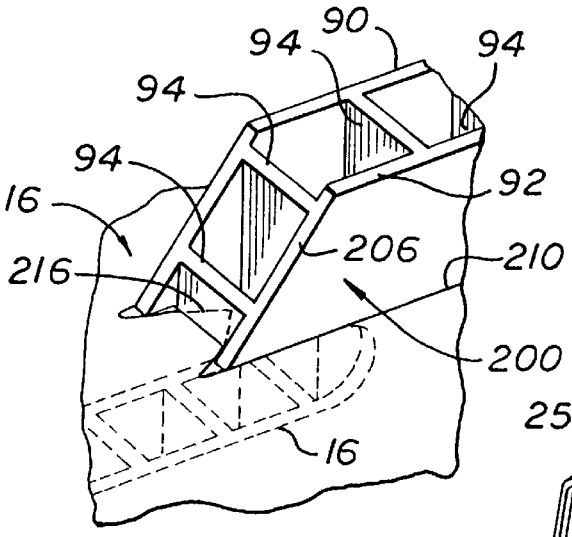
FIG. 5C
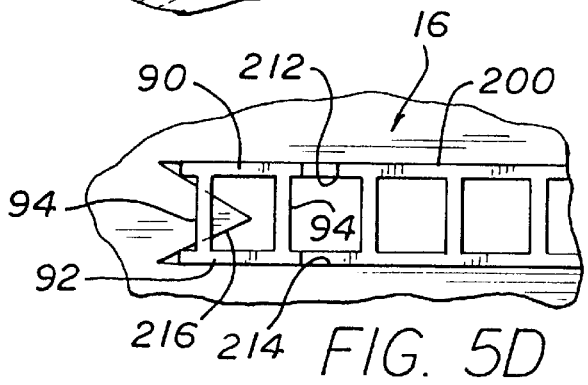
FIG. 5D
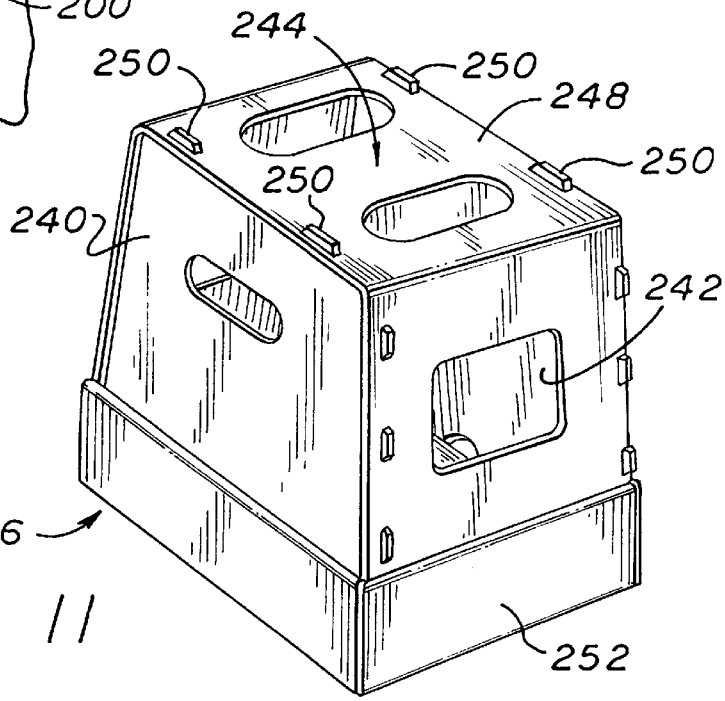
FIG. 11

ASPARAGUS BOX

BACKGROUND OF THE INVENTION

1. Field of the Invention

The present invention relates to packaging and, more particularly, to containers for asparagus being harvested.

2. Description of Related Art

At the time of manually harvesting asparagus, fieldhands place the cut asparagus in an asparagus box lying on its side, which box has converging sides. Upon fill of the box, a cover (referred to as a tray) is placed over the opening of the asparagus box and the resulting container is stacked with the cover lowermost such that the asparagus box tapers upwardly.

During harvesttime for asparagus and as a function of the size of the crop, hundreds, if not thousands, of containers are required. To minimize shipping and transportation costs of these containers to a field, they are shipped unassembled with the components being configured sheets stacked upon one another. Assembly at the field must necessarily be without the use of tools, adhesives, jigs, etc. Furthermore, the assembly must be easily managed with minimal instruction and the assembled asparagus boxes and trays must remain assembled during handling and use with minimal failures. Because of the possibility of inclement weather before and after fill of the asparagus boxes, as well as during uncovered transport thereof, the containers must be essentially impervious to water and permit drainage of any water actually collected therein.

In the field, the filled containers may have to be temporarily stacked in high stacks. Furthermore, during transport, the containers are stacked relatively high as a function of the carrying capacity of the vehicle or trailer. When stacked, the containers must not be easily slidable relative to one another in order to maintain the integrity of the stacks and prevent tipping with attendant discharge of the asparagus.

SUMMARY OF THE INVENTION

The asparagus box includes a wrap bent along two transverse score lines to define the top and opposed sides. A plurality of slots are formed along the longitudinal edges of the wrap. A pair of heads having converging opposed edges terminating at a top edge includes a plurality of laterally extending tabs. Each of these tabs has opposed overhang elements. The tabs penetrably engage corresponding slots along the respective longitudinal edge of the wrap to form the asparagus box. Disengagement of the tabs with the slots is prevented by the respective overhang elements extending past the respective lateral edges of the slots. A tray is formed by folding portions of the four edges thereof upon themselves to define side walls sized to receive and support the open end of the asparagus box. The tray includes slots disposed in its base positioned and sized to correspond with the tabs protruding from the top of an asparagus box upon which it is to be stacked, which tab and slot engagement prevents sliding movement between adjacent stacked containers.

It is therefore a primary object of the present invention to provide an asparagus box easily assemblable by fieldhands during harvesttime.

Another object of the present invention is to provide an asparagus box having interconnecting tabs and slots for maintaining the integrity of the assembled asparagus box during filling and transport of the asparagus.

Still another object of the present invention is to provide tabs having opposed elements to overhang the lateral edges of a penetrated slot to prevent withdrawal of the tab.

Yet another object of the present invention is to provide a plurality of drain holes for evacuating fluids from within an asparagus box.

A further object of the present invention is to provide a tab interlock mechanism incorporating the walls of the corrugated plastic sheet from which an asparagus box is made to interlock tabs with the penetrated slots.

A still further object of the present invention is to provide an inexpensive, readily assemblable and robust asparagus box.

A still further object of the present invention is to provide an asparagus box which may be disassembled and reassembled without significant damage.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which:

FIGS. 5A, 5B, 5C, and 5D illustrate the steps and attendant structures for interlocking the tabs of a head with the slots of the wrap;

FIG. 11 illustrates an embodiment of the present invention useable for a box size essentially half that shown in FIGS. 1 and 1A.

DETAILED DESCRIPTION OF THE PREFERRED EMBODIMENT

Figure 1:
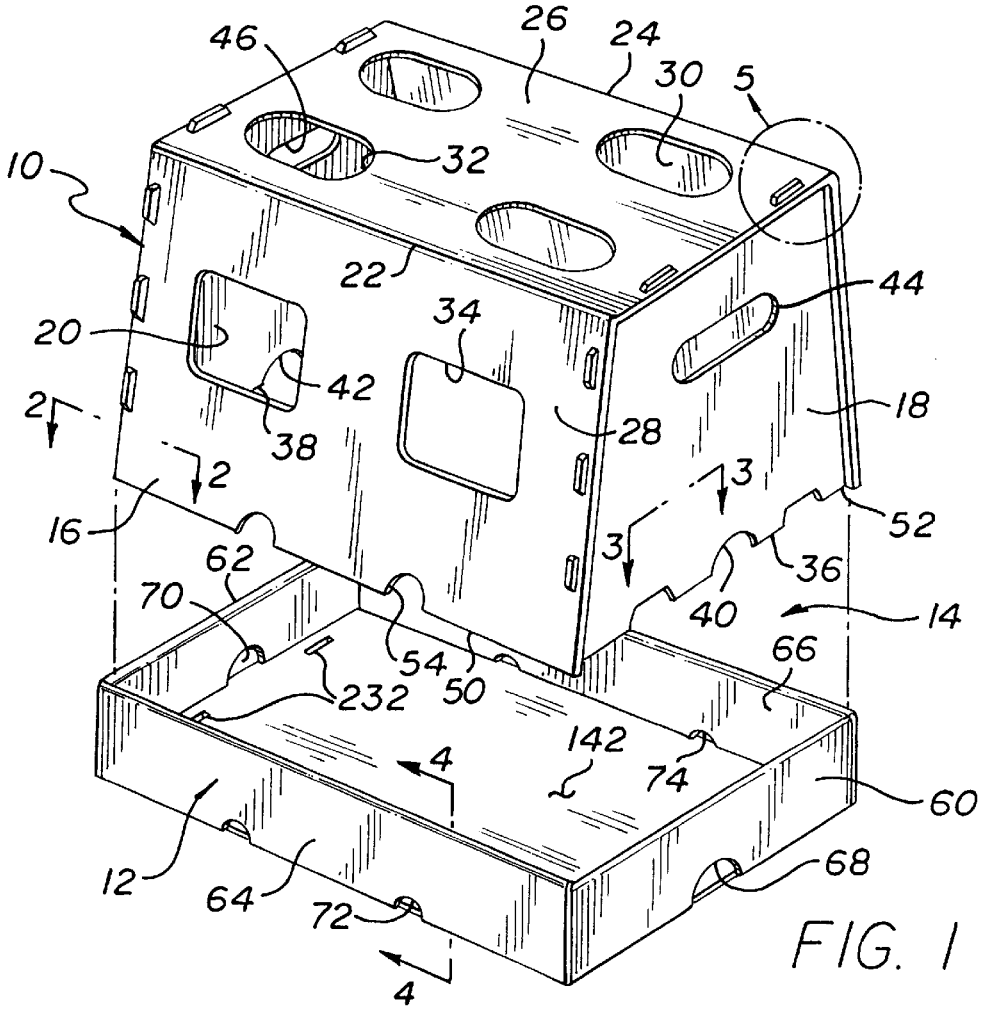
FIG. 1 illustrates a perspective view of an asparagus box and its accompanying tray.
Figure 8:
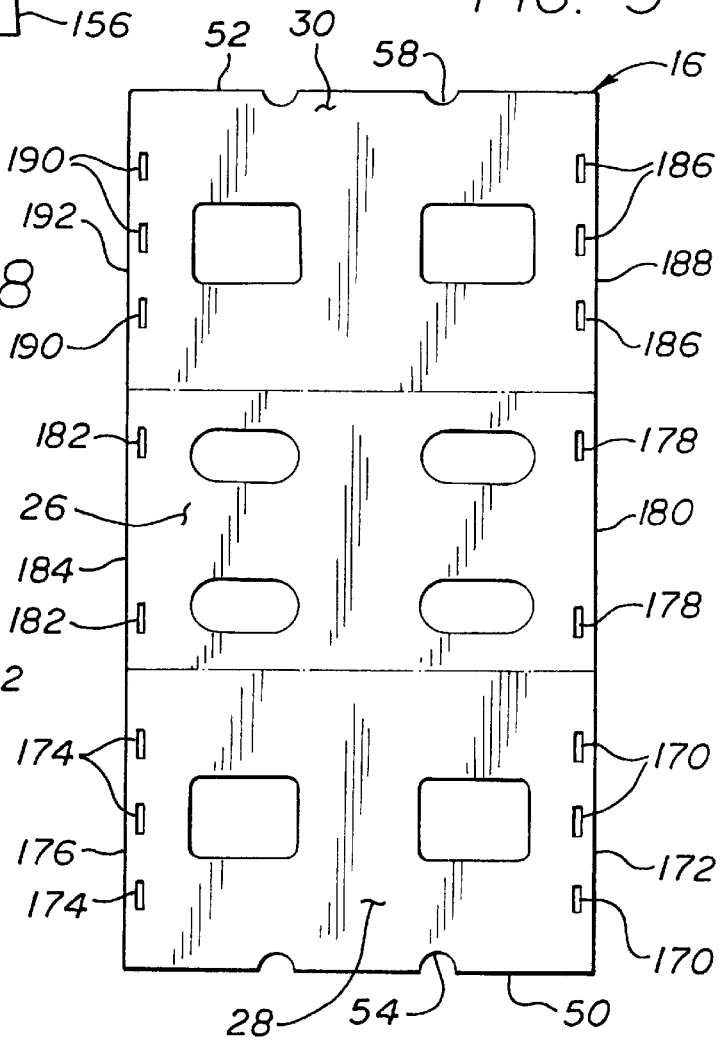
FIG. 8 is a plan view of the wrap shown in its unfolded state.

Referring to FIG. 1, there is shown a perspective view of an asparagus box 10 and associated cover, herein referred to as tray 12, and collectively referred to as container 14. The asparagus box is formed from three pieces of corrugated plastic sheet material, which pieces are referred to in the trade as the wrap 16 and heads 18,20. The wrap is a single piece of material having fold lines 22,24 defining top 26 and sides 28,30. Head 18 defines one end of the asparagus box and head 20 defines the opposed end of the asparagus box. A plurality of apertures 32 are formed in top 26 for ventilation and drainage purposes. Similarly, a plurality of apertures 34 are formed in each of sides 28,30 for ventilation and drainage purposes. The bottom edge 36,38 of each of heads 18,20 may include a plurality of indentations 40,42 for drainage purposes. Moreover, elongated apertures 44,46 may be formed in each of heads 18,20 as handholds and also serve for ventilation purposes. Opposed edges 50,52 of wrap 16 may include a plurality of indentations 54,56 (as shown in FIG. 8) for drainage purposes.

Figure 1A:
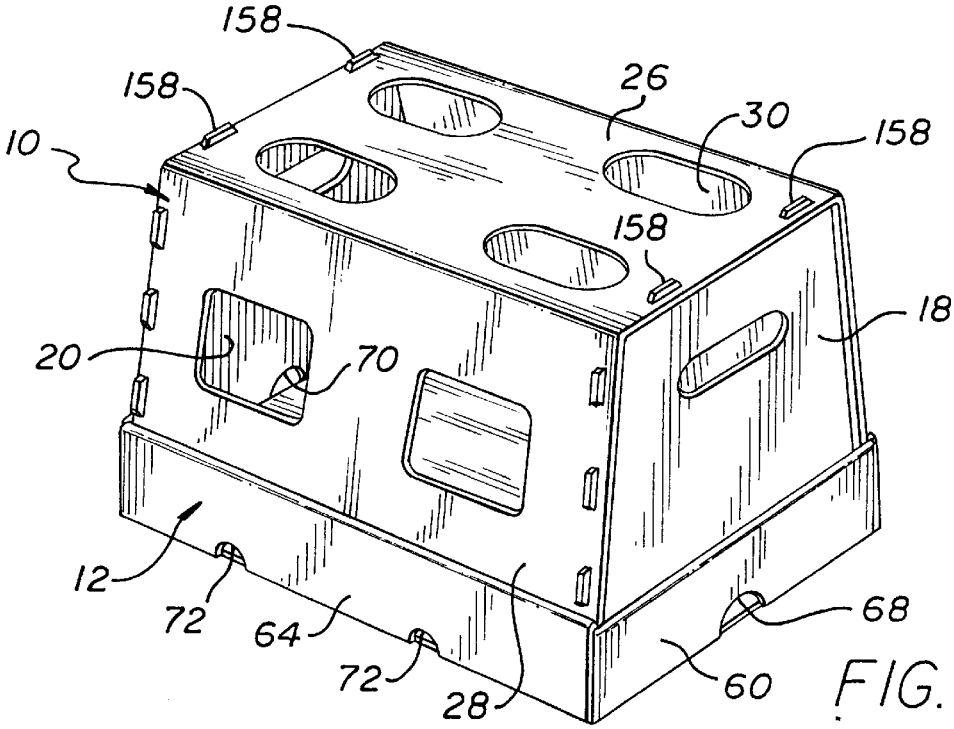
FIG. 1A illustrates an asparagus box lodged within its supporting tray, collectively defining a container for asparagus.

Tray 12 includes sides 60, 62, 64 and 66 which overlap the corresponding edges of the head and the wrap of asparagus box 10 upon mating of the tray with the asparagus box, as shown in FIG. 1A. Sides 60 and 62 include apertures 68,70 for drainage purposes. Similarly, sides 64,66 may include one or more apertures 72,74 for drainage purposes.

Figure 2:
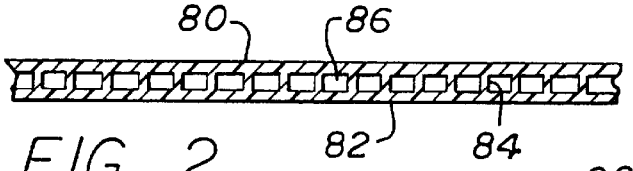
FIG. 2 is a cross-sectional view taken along lines 2—2, as shown in FIG. 1, and depicting the flutes of a 3 mm thick corrugated plastic sheet used for the wrap.
Figure 3:
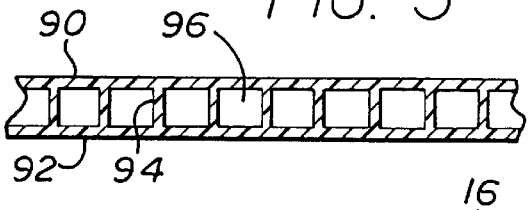
FIG. 3 is a cross-sectional view taken along lines 3—3, as shown in FIG. 1, and depicting the flutes of a 6 mm thick corrugated plastic sheet used for the heads.

FIGS. 2 and 3 illustrate corrugated plastic sheet material of the type adapted for use in the present invention. In particular, FIG. 2 illustrates a representative 3 mm thick sheet material having opposed sides 80,82 separated from one another by a plurality of walls 84. Adjacent pairs of walls, in combination with sides 80,82, define a plurality of hollow rectangular tubes 86. Sheet material of this thickness is suitable for use in constructing wrap 16 and tray 12. Heads 18,20 are preferably formed of thicker corrugated plastic sheet material, as shown in FIG. 3, having a thickness of 6 mm. Herein, sides 90,92 are separated by a plurality of walls 94. Pairs of walls in combination with sides 90 and 92 define a plurality of hollow tubes 96. The resulting structural strength of the components of container 14 is adequate for resisting the strength and robustness requirements during fill and shipment of the containers. Furthermore, the container so constructed will have sufficient strength to resist numerous cycles of assembly, disassembly, and reuse.

Figure 4:
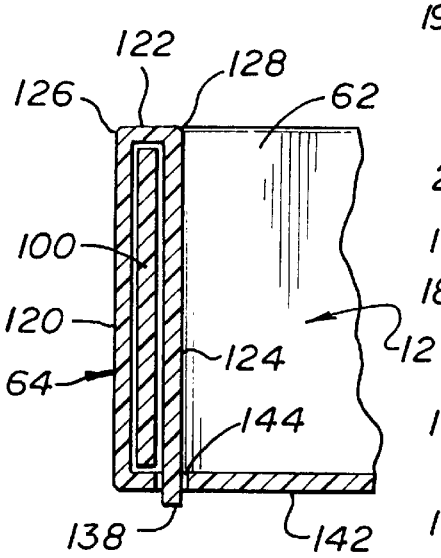
FIG. 4 is a partial cross-sectional view taken along lines 4—4 as shown in FIG. 1.
Figure 7:
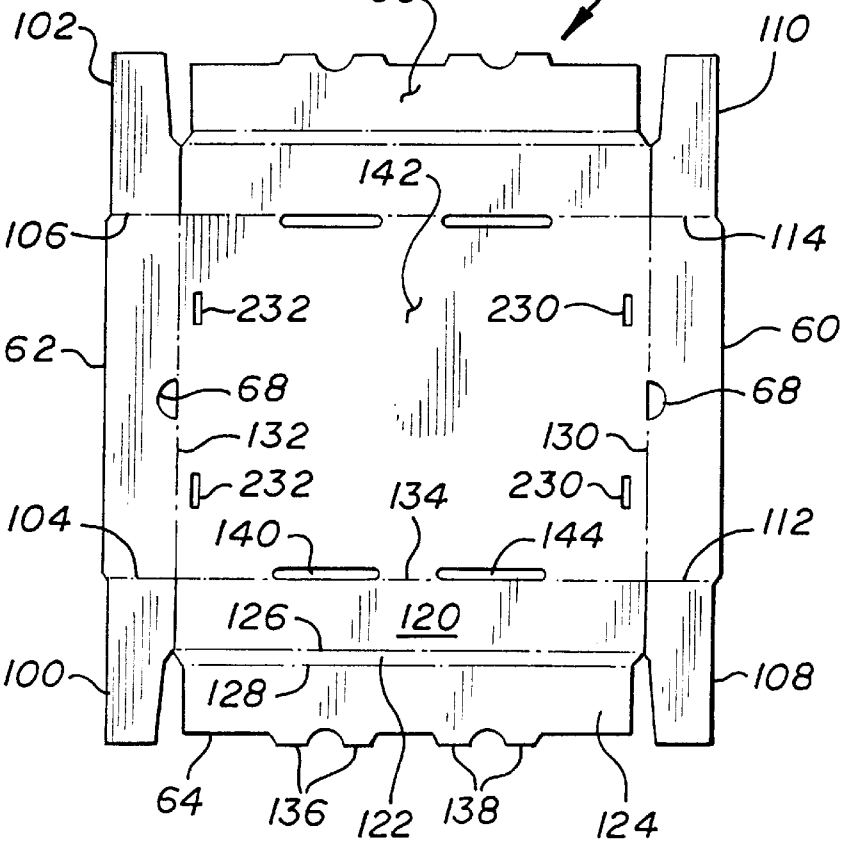
FIG. 7 is a plan view of the tray shown in its unfolded state.

Referring in combination to FIGS. 1, 4, and 7, assembly of tray 12 will be described. Sides 62 includes a pair of tabs 100,102 foldable inwardly along fold lines 104,106, respectively. Similarly, side 60 includes a pair of tabs 108,110 foldable inwardly along fold lines 112,114, respectively. Side 64 includes three panels 120, 122, and 124 foldable along fold lines 126 and 128. After folding sides 60,62 upwardly along fold lines 130,132, tabs 108 and 100 are bent inwardly along fold lines 112,104. Panel 120 is folded upwardly along fold line 134 adjacent folded tabs 108,100. Panel 122 is folded across the top edge of tabs 108,100 along fold line 120 and panel 124 is folded along the interior sides of tabs 108,100 along fold line 128. To retain panel 124 in place, tabs 136 are inserted into slots 140 in bottom 142 of tray 12 and tabs 138 are inserted into similar slots 144. The panels of side 66 are similarly folded about tabs 110,102. Disassembly of tray 12 is accomplished by reversing the above process.

Referring jointly to FIGS. 1, 1A, 6 and 8, assembly of heads 18,20 with wrap 16 will be described. Each of heads 18,20 includes a plurality of tabs extending from edge 152 and a further plurality of tabs 154 extending from edge 156. A pair of tabs 158 extend from edge 160 of each head. Wrap 16 includes a plurality of slots 170 adjacent edge 172 of side 28 and a further plurality of slots 174 disposed adjacent edge 176 of the side. These slots correspond in number and location with tabs 150 in edge 152 of each of heads 18,20. Slots 178 are formed in top 26 adjacent edge 180 and further slots 182 are formed adjacent edge 184 of the top. These slots correspond in position with tabs 158 extending from edge 180 of each of heads 18,20. Slots 186 are formed adjacent edge 188 of side 30 and slots 190 are formed adjacent edge 192 of the side. These slots correspond in position and number with tabs 154 extending from edge 156 of each of heads 18 and 20. Wrap 16 is assembled with heads 18,20 by penetrably engaging the tabs of the heads with the respective slots of the wrap, as related above.

Figure 5:
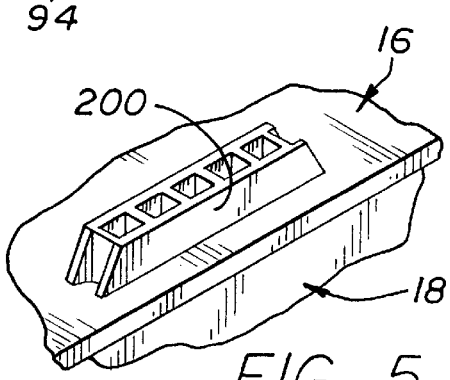
FIG. 5 is an exploded view taken within circle 5 shown in FIG. 1.

The penetration and locking of the tabs with the respective slots will be described in further detail with joint reference to FIGS. 5, 5A, 5B, 5C, and 5D. The portion of a tab 200 extending from one of the heads, such as head 18 and protruding through wrap 16 is essentially trapezoid shaped, as depicted in FIG. 5. The details attendant penetrable engagement and locking thereafter will be described with joint reference to FIGS. 5A, 5B, 5C, and 5D. Tab 200, which is representatively depicted as any one of tabs 150, 154 and 158, includes opposed overhangs 202 and 204. These overhangs include converging edges 206,208, respectively. The space between each overhang and the underlying edge 160 of head 18 is equivalent to the thickness of wrap 16, representatively 3 mm, as depicted in FIG. 2. Slot 210, which is representative of any one of slots 170, 174, 178, 182, 186 and 190, is formed by spaced apart sides 212,214 and opposed ends 216,218. Each of ends 216,218 is triangle shaped and has an apex extending toward the other triangle shaped end. Upon insertion of tab 200 through slot 210, ends 216,218 will be forced upwardly by the intermediate corrugation wall(s) 94 (see FIG. 5B). After full penetration of tab 200, as depicted in FIG. 5C, ends 216,218 will be clear of attendant wall(s) 94 and the ends will become unbent and rest in the plane of wrap 16. The resulting interference between ends 216,218 and wall(s) 94 of tab 200 will tend to dissuade withdrawal of the tab from slot 210. The interference therebetween to dissuade withdrawal is particularly illustrated in FIG. 5D. Nevertheless, the tab can be withdrawn, which withdrawal results in temporary bending of ends 216,218 in the direction opposite from that shown in FIG. 5B. During the insertion process, sides 90,92 of each overhang slide through the slot between the respective slot sides 212,214 and the respective triangular shaped end 216,218. Such passage tends not to damage or otherwise affect the structural integrity of the sides of the tabs.

It is to be particularly noted that insertion and withdrawal will not require compression, deformation, or other disfigurement of the overhanging opposed portions of the tab. The latter, if it were to occur, would severely jeopardize the integrity of the retention capability between a tab and its accompanying slot. This is a particular problem in prior art tab and slot junctions.

Figure 6:
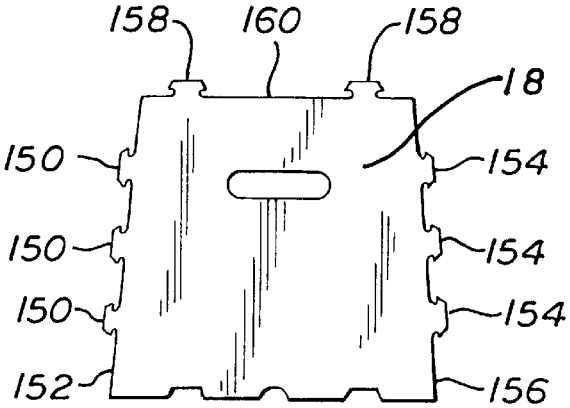
FIG. 6 is a plan view of a head.

As particularly noted in FIGS. 6, 7, and 8, the components of each container can be shipped in unfolded configuration for assembly on site. After use, the components of the container may be disassembled and the components thereafter stacked for reshipment and reuse.

Figure 9:
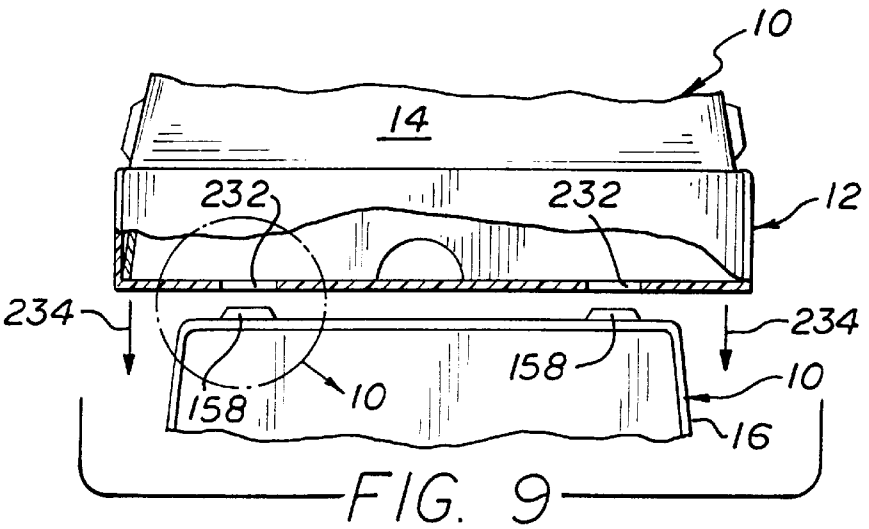
FIG. 9 illustrates the step of stacking two asparagus boxes atop one another.
Figure 10:
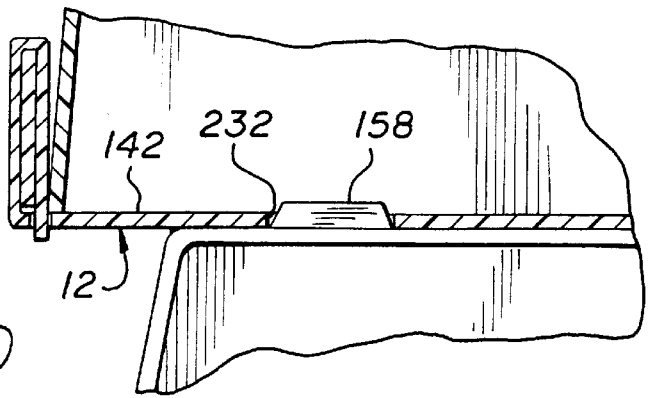
FIG. 10 is a detail view taken within circle 10 shown in FIG. 9 and depicting engagement of a protruding tab with a corresponding slot in the tray after stacking and to prevent sliding movement between two stacked containers.

Stacking of containers 14 upon one another is necessary during harvesttime and shipment of the contained asparagus. Such stacking, as shown in FIGS. 9 and 10, should ensure that the stacked containers do not slide relative to one another. For this purpose, each of trays 12 includes a pair of slots 230 and 232 disposed generally adjacent sides 60,62, respectively (as shown in FIGS. 1 and 7). These slots are penetrably engaged by respective ones of pairs of tabs 158, as shown in FIGS. 1A and 6. Upon placing a container 14 in stacked relationship upon an underlying container by lowering it thereupon, as depicted by arrows 234, tabs 158 will penetrably engage slots 232. Similarly, a further pair of tabs 158 will engage slots 230. Such engagement is depicted in FIG. 10. The interference between stacked containers due to penetration of tabs 158 into respective ones of slots 230 and 232 will preclude sliding sideways movement between stacked containers. Thereby, lateral forces imposed upon stacks of containers will not result in sliding movement of the containers relative to one another. Furthermore, slight tipping of the stacks of containers will be unlikely to cause disruption of the stacks.

Referring to FIG. 11, there is illustrated a somewhat modified configuration of a smaller sized asparagus box and tray. More specifically, heads 240,242 of asparagus box 244 define the major axes of container 246 and wrap 248 defines the minor axes. For this reason, tabs 250, the equivalent of tabs 158, are disposed along the major axes and not the minor axes, as shown in FIG. 1. Necessarily, tray 252 is reduced in size but otherwise remains essentially unchanged.

In the industry, container 14, illustrated in FIG. 1A, is a standard sized container. Container 246, illustrated in FIG. 11, is essentially half the size of container 14; it is also an industry standard size container. Except for the major differences noted above, containers 14 and 246 are constructed, assembled, and disassembled for later reuse in the same manner as discussed above.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A container for asparagus formed from corrugated plastic sheet materials, said container comprising in combination:

(a) an asparagus box having a pair of heads of the sheet material, each head having opposed side edges and a top side edge and a wrap of the sheet material secured to the opposed side edges and the top side edge of each head of said pair of heads, said wrap having three panels defining opposed side panels and a top panel, said pair of heads and opposed ends of said wrap defining an open end of said asparagus box; and (b) each head of said pair of heads including a plurality of tabs extending from the opposed side edges and the top side edge;

(c) said wrap including a plurality of slots disposed along the edges of the opposed side panels and the top panel for penetrably receiving said plurality of tabs;

(d) each slot of said plurality of slots includes a pair of opposed sides and a pair of triangular shaped ends defining an apex;

(e) each tab including an opposed pair of overhangs defined by opposed sides of the corrugated sheet material and a wall extending therebetween for interferingly engaging the apex upon insertion and withdrawal of each of said tabs from one of said slots;

(f) a tray for receiving the open end of said asparagus box to close said asparagus box and form said container.

2. The container as set forth in claim 1 including a plurality of tabs extending through the top of said wrap from each head of said pair of heads and a plurality of slots disposed in said tray for penetrably receiving said plurality of tabs of an underlying one of said containers upon stacking of said containers to prevent relative sliding movement of stacked ones of said containers.

3. The container as set forth in claim 1 wherein said opposed side edges of each head of said pair of heads are converging edges for engaging said opposed side panels of said wrap.

4. The container as set forth in claim 1 wherein each of said wrap, said pair of heads, and said tray includes at least one aperture for drainage and ventilation purposes.

5. An asparagus box for receiving, storing and shipping freshly cut asparagus, said asparagus box comprising in combination:

(a) a wrap formed of a sheet of corrugated plastic material;

(b) a pair of opposed heads having opposed side edges, a top edge and a bottom edge formed of a sheet of corrugated plastic material for defining in combination with said wrap said asparagus box;

(c) a plurality of tabs extending from each of said opposed side edges and said top edge of each head of said pair of heads, each of said tabs including opposed overhangs; and (d) a plurality of slots disposed along opposed edges of said wrap corresponding to each of said tabs, each said slot including a pair of opposed triangular shaped ends, each end of said opposed ends having an apex for restraining disengagement of said tab from said slot by interfering with said overhang upon withdrawal of said tab after penetrable insertion of said overhang of said tab through said slot.

6. The asparagus box as set forth in claim 5 wherein each of said opposed overhangs includes walls of the corrugated sheet material for interferingly engaging the apices at said pair of ends.

7. The asparagus box as set forth in claim 6 wherein each of said slots includes a pair of opposed sides and wherein each side of the corrugated sheet material of said tab penetrates said slot intermediate the apex and one of the sides of said slot.

8. The asparagus box as set forth in claim 6 wherein each said triangular shaped end of said slots is bendable to accommodate insertion and removal of a tab of said tabs.

9. The asparagus box as set forth in claim 5 wherein each of said slots includes a pair of opposed sides and wherein each side of the corrugated sheet material of said tab penetrates said slot intermediate the apex and one of the sides of said slot.

10. The asparagus box as set forth in claim 5 wherein said plurality of slots include three slots disposed along opposed edges of said wrap and wherein said plurality of tabs are disposed along said opposed side edges and said top edge of each head of said pair of heads.

11. An asparagus box for receiving, storing and shipping freshly cut asparagus, said asparagus box comprising in combination:

(a) a wrap formed of a sheet of corrugated plastic material;

(b) a pair of opposed heads having opposed side edges, a top edge and a bottom edge formed of a sheet of corrugated plastic material for defining in combination with said wrap said asparagus box;

(c) at least one tab extending from each of said opposed side edges and said top edge of each head of said pair of heads, each of said tabs including opposed overhangs;

(d) a slot disposed in said wrap corresponding to each of said tabs, each said slot including a pair of opposed triangular shaped ends, each end of said opposed ends having an apex for restraining disengagement of said tab from said slot by interfering with said overhang upon withdrawal of said tab after penetrable insertion of said overhang of said tab through said slot; and (e) each overhang of said tabs including opposed sides of the corrugated plastic sheet material and a segment of a wall member interconnecting the sides of the sheet material for interferingly engaging the apices of said pair of triangular shaped ends during insertion and removal of said tabs relative to said slots.

* * * * *